US005664278A

United States Patent [19]

Reisman

[11] Patent Number: 5,664,278

[45] Date of Patent: Sep. 9, 1997

[54] VEGETABLE AND FRUIT BRUSH

[76] Inventor: Morris Reisman, 17801 Cardinal Cir., Villa Park, Calif. 92667

[21] Appl. No.: 677,140

[22] Filed: Jul. 9, 1996

[51] Int. Cl.[6] ..... A46B 1/00; A46B 9/02

[52] U.S. Cl. ..... 15/160; 15/187; 15/DIG. 5

[58] Field of Search ..... 15/159.1, 160, 15/167.1, 167.3, 187, 188, 207.2, DIG. 5

[56] References Cited

U.S. PATENT DOCUMENTS

| | | | |
|---|---|---|---|
| Re. 26,403 | 6/1968 | Kutik | 15/187 |
| 1,491,016 | 4/1924 | McGowan | 15/188 |
| 2,043,898 | 6/1936 | Malcolm | 15/167.1 |
| 2,225,331 | 12/1940 | Campbell | 15/167.1 |
| 2,468,689 | 4/1949 | Schriner | 15/188 |
| 3,497,900 | 3/1970 | Kutik | 15/187 |
| 3,744,078 | 7/1973 | Vallis | 15/167.3 |
| 3,843,991 | 10/1974 | Vallis | 15/167.3 |
| 4,325,392 | 4/1982 | Iten | 15/187 |
| 4,343,265 | 8/1982 | Belschner | 15/188 |
| 4,360,940 | 11/1982 | Smith | 15/160 |
| 4,480,351 | 11/1984 | Koffler | 15/187 |
| 5,060,337 | 10/1991 | Van Niekerk | 15/188 |
| 5,072,479 | 12/1991 | Van Niekerk | 15/188 |
| 5,396,678 | 3/1995 | Bredall | 15/207.2 |
| 5,419,001 | 5/1995 | Wan | 15/DIG. 5 |

FOREIGN PATENT DOCUMENTS

| | | | |
|---|---|---|---|
| 2502918 | 10/1982 | France | 15/167.1 |
| 0180491 | 1/1907 | Germany | 15/167.1 |
| 1253668 | 11/1967 | Germany | 15/187 |

*Primary Examiner*—David Scherbel
*Assistant Examiner*—Randall Chin
*Attorney, Agent, or Firm*—Edgar W. Averill, Jr.

[57] ABSTRACT

A brush for cleaning foodstuff, especially fragile foodstuff such as ears of fresh corn and mushrooms. The brush has a handle portion which supports many straight rows of bristles. The rows of bristles are not parallel but get closer together near one end of the brush. The bristles are fabricated from a very soft polymer and are positioned at different heights along the bottom of the brush. The shortest bristles are near the center so that the brush can be used on a curved surface such as an ear of corn, a mushroom, or a carrot among other fruits and vegetables.

10 Claims, 2 Drawing Sheets

VEGETABLE AND FRUIT BRUSH

BACKGROUND OF THE INVENTION

The field of the invention is brushes and the invention relates more particularly to brushes for cleaning fruits and vegetables. Relatively stiff brushes are commonly used to clean potatoes but such brushes are not suitable for more fragile foodstuffs such as an ear of fresh corn. While the ear of corn does not typically need cleaning, it does have corn silk which is tedious to remove. Other vegetables such as mushrooms have a very tender skin and are not properly cleaned with the conventional vegetable brush.

One brush has been developed for the specific purpose of removing corn silk. This brush is disclosed in U.S. Pat. No. 3,805,313 and is made from a wire screen. A wire screen would tend to damage the tender kernels of an ear of corn. Also, a one-piece polyethylene surgeon's scrub brush has been sold purportedly for removing corn silk. The bristles of this brush are all one height. Because of the flat face of the brush, it must be pressed very hard against the corn to attempt to get in between the rows of kernels where the silk is located. Because of the stiffness of the bristles, and the brushing pressure required, kernels are likely to be damaged. The total effect of the cleaning is also imperfect.

BRIEF DESCRIPTION OF THE INVENTION

It is an object of the present invention to provide a brush for cleaning fruits and vegetables, especially fragile fruits and vegetables, for example for removing the silk from an ear of corn and brushing the foreign particles from fresh mushrooms.

The present invention is for a brush having a handle portion with right and left sides and a front and back and a floor. A plurality of straight rows of bristles extending downwardly from the floor and the rows converge so that they are closer together at one end than they are at the other end. Preferably the brush is fabricated from a very soft polymer having a Shore hardness of 70. Also preferably each row has bristles of a single length but different rows have bristles of several different lengths. Preferably the bristles adjacent the sides of the brush are longer than those in the center of the brush and also preferably there are rows of longer bristles adjacent a series of rows of shorter bristles to assist in the operation of corn silk removal. Also preferably the bristles are generally rectangular in cross-section but having one curved side and the length of the cross-section is about two times the width. Also preferably the brush is injection molded so that the handle and bristles are one integral piece.

DESCRIPTION OF THE PREFERRED EMBODIMENTS

Figure 1:
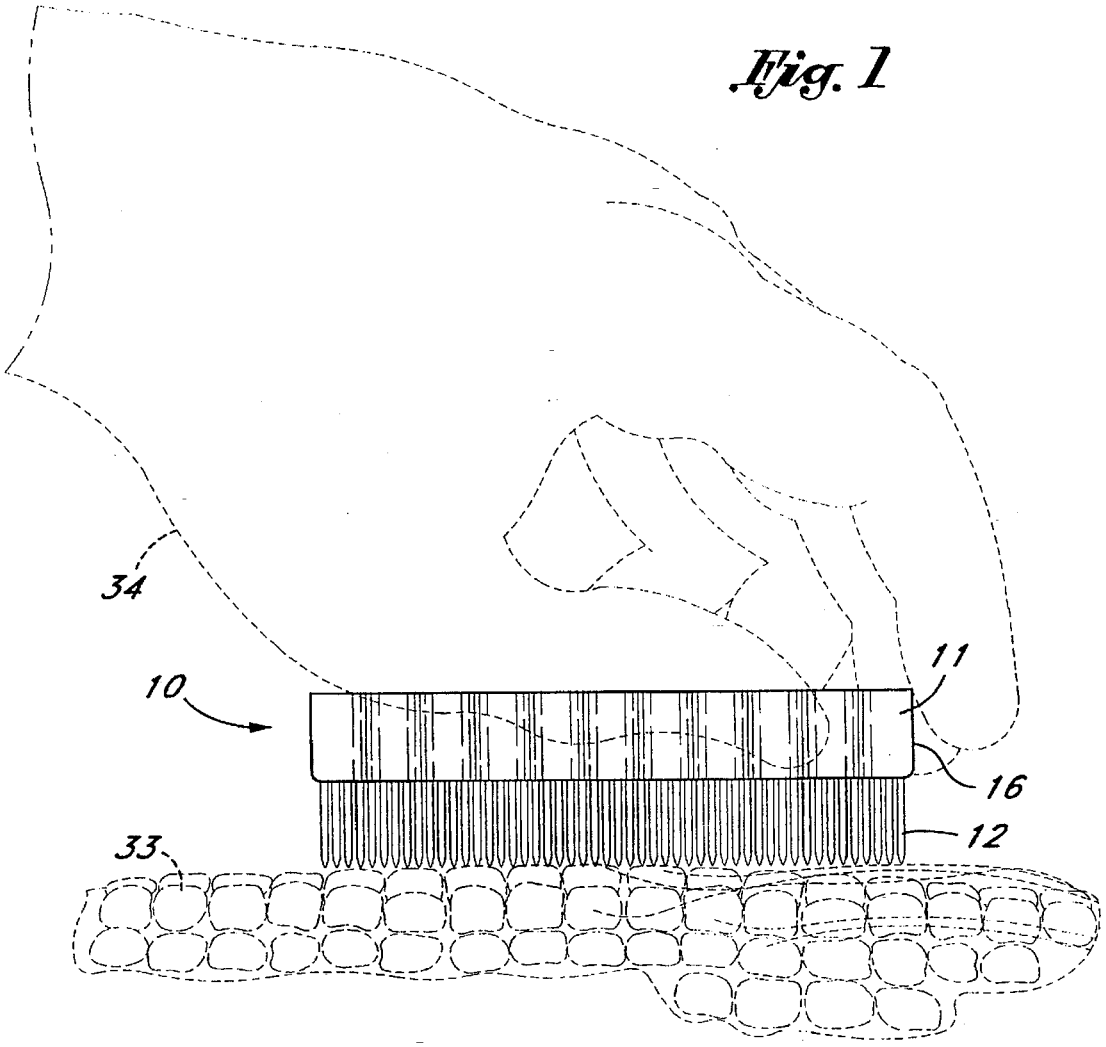
FIG. 1 is a side view of the brush of the present invention showing a user's hand and an ear of corn in phantom view.

The brush of the present invention is indicated by reference character 10 in FIG. 1 and has a handle 11 and a plurality of bristles 12. The brush is shown in bottom view in FIG. 2 where it can be seen that the bristles are generally arranged in rows such as rows 13, 14 and 15. As is evident in FIG. 2, the rows are "non-parallel" in that they are more closely spaced at first end 16 than they are at second end 17.

Figure 7:
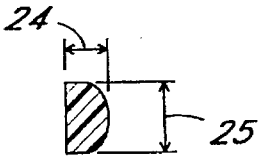
FIG. 7 is a cross-sectional view of a single bristle of the brush taken along line 7—7 of FIG. 6.

Handle 11 has a first end 16, a second end 17, a right side 18 and a left side 19. As shown best in FIG. 5, brush 10 is injection molded to form one integral piece. The handle portion is open at the top 20 and the open top has a floor 21 which has an upper surface 22 and a lower surface 23. A plurality of bristles 12 extend downwardly from the floor 21. Each bristle has a generally rectangular cross-section such as that shown in FIG. 7 but having one curved side to assist in molding the brush. This cross-sectional shape has a width 24 and a length 25. Each bristle is tapered from base to tip, the longer bristles forming an angle of about 4 degrees as indicated by reference character 34 and the shorter bristles forming an angle of about 7 degrees. The intermediate bristles form an intermediate angle from tip to base. Preferably the length is about two times the width. Each bristle also terminates in an angled point such as that indicated by reference character 26 in FIG. 5. Preferably this angled point has an angle of about 30°.

Figure 5:
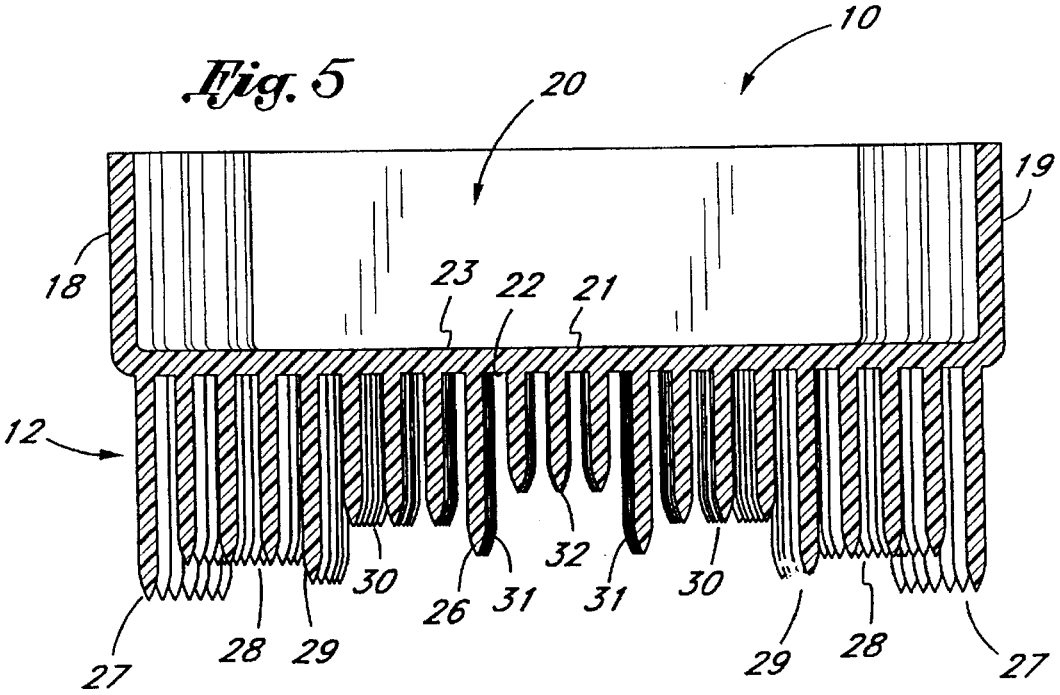
FIG. 5 is an enlarged cross-sectional view taken along line 5—5 of FIG. 2.
Figure 6:
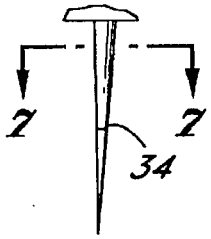
FIG. 6 is a side view of a single bristle.

An important feature of the present invention is the arrangement of the lengths of the bristles so that the brush is capable of providing a very light scrubbing action when held lightly against the fruit or vegetable being scrubbed since only the longer bristles need to touch the fruit. With a little more pressure additional bristles are brought into play. Referring to FIG. 5, the particular embodiment of the brush shown in the drawings has two outer rows of bristles 27 which are the longest of all bristles. Three rows of shorter bristles 28 are inward with respect to outer rows 27. Two longer rows of bristles 29 are longer than rows 28 but shorter than rows 27 and three yet shorter rows 30 are positioned centrally with respect to rows 29. Two rows of bristles 31 are positioned inwardly from rows 30 and are longer than rows 30 and surround three of the shortest rows 32. The result is a generally stepped under surface as viewed in FIG. 5 with the shortest bristles near the center and the longer bristles nearer the sides. This generally approximates a curved surface with single longer rows in between. This shape helps conform the shape of the brush to the typical fruit or vegetable which invariably has a curved surface. Specifically for removing the silk from an ear of corn, the shape of the brush helps to provide a relatively even force along the face of an ear of corn. An ear of corn is indicated in phantom view in FIG. 1 by reference character 33. The user's hand is indicated in phantom view in FIG. 1 by reference character 34.

The softness of he material from which the brush is made is also very unusual for a brush. The Shore hardness of 70 is very soft not unlike that of the softest of pencil erasers. Various food grade polymers can be used which have the ability to be injection molded in the shape shown. Some foodstuffs such as mushrooms should not be held under running water as they will absorb the water like a sponge and their flavor will be negatively affected. Also, the mushroom will deteriorate more rapidly. Thus, a very soft brush such as the brush of the present invention made in a hardness such as Shore 60 is ideal to clean mushrooms without destroying any flavor or damaging the surface of the mushroom.

Figure 2:
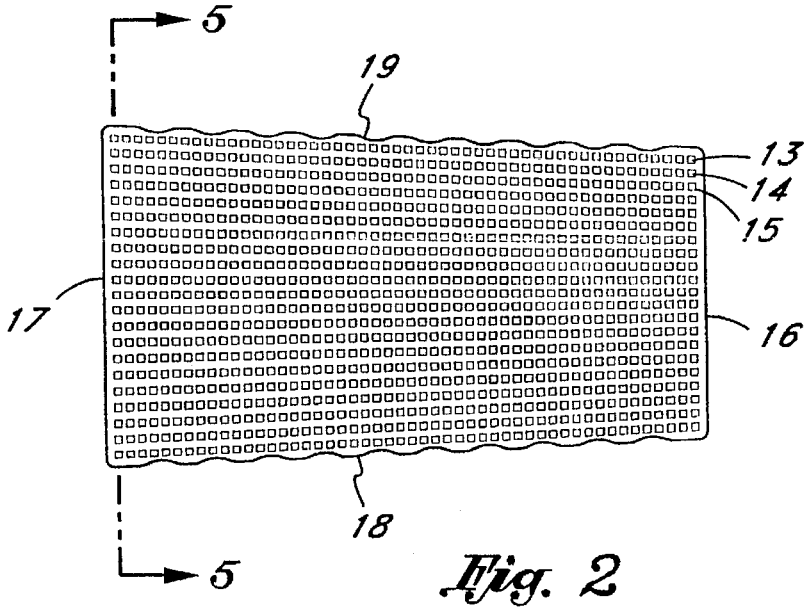
FIG. 2 is a bottom view of the brush of FIG. 1.
Figure 3:
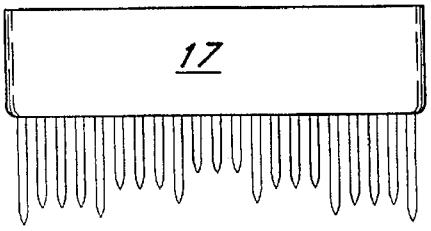
FIG. 3 is an end view showing the second end of the brush of FIG. 1.
Figure 4:
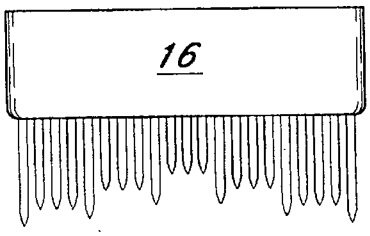
FIG. 4 is an end view showing the first end of the brush of FIG. 1.

Although a Shore hardness of 70 is recommended for most uses, it is contemplated that the brush of the present invention can be fabricated from a harder polymer and used for cleaning carrots and potatoes. It can also be made softer such as a Shore of 60 for cleaning mushrooms. The generally stepped shape with and the different levels of bristles and non-parallel rows as viewed in FIG. 2 provide a very complete cleaning action. This is because the movement of the brush in a straight line for instance, in the direction of a row of kernels causes the individual bristles in the rows of bristles away from the center rows to move inwardly as the brush is moved from its wide end to its narrow end. Thus, essentially no part of the food is left untouched by a bristle.

The present embodiments of this invention are thus to be considered in all respects as illustrative and not restrictive; the scope of the invention being indicated by the appended claims rather than by the foregoing description. All changes which come within he meaning and range of equivalency of the claims are intended to be embraced therein.

I claim:

1. A brush for cleaning foodstuff, said brush comprising:

a handle portion having a right side, a left side, a central axis midway between said right and left sides, first and second ends comprising a front and a back, a floor having an upper surface and a lower surface;

a plurality of rows of bristles extending downwardly from said floor, said plurality of rows extending from said floor near said front of said handle portion and extending to a position from said floor near said back of said handle portion, said rows being almost parallel to said central axis, but converging so that the rows are closer together at one of said first and second ends than at the other of said ends, said handle portion and said plurality of rows of bristles being molded in a single piece.

2. The brush for cleaning foodstuff of claim 1 wherein each row of bristles has a common bristle length and the common bristle length of some rows is longer than the common bristle length of at least one other row.

3. The brush for cleaning foodstuff of claim 2 wherein the common bristle length of rows near the right side and the left sides are longer than the common bristle length of rows nearer said central axis.

4. The brush for cleaning foodstuff of claim 2 wherein the rows are arranged in a pattern wherein a single row having a first length is adjacent a plurality of rows having a second length which is shorter than said first length.

5. The brush for cleaning foodstuff of claim 4 wherein there are three rows having said second length adjacent said single row having a first length.

6. The brush for cleaning foodstuff of claim 1 wherein each bristle has a rectangular cross section having two sides, a front and a back, wherein the length of said rectangular cross section from side to side is about two times the width from front to back.

7. A brush for cleaning foodstuff molded as a single piece, said brush comprising:

a handle portion having a right side, a left side, a first end and a second end and a bottom floor having an upper surface and a lower surface;

a plurality of bristles extending downwardly from said bottom floor;

said single piece having a hardness of no more than 70 Shore A;

said plurality of bristles being arranged in straight rows of a common bristle length in each row from the first and to the second end and with shorter bristles being located in a middle area between the right side and left side and longer bristles being located near the right and left sides: and wherein each of said plurality of bristles has a generally rectangular cross-section having to sides, a front and a back, wherein the length of each of said bristles of said rectangular cross-section from side to side is two times the width from front to back.

8. The brush for cleaning foodstuff of claim 7 wherein each bristle has a lower end having an angled point.

9. The brush for cleaning foodstuff of claim 8 wherein said angled point has an angle of about 30°.

10. The brush for cleaning fragile foodstuff of claim 7 wherein said rows of bristles include a single longer row of bristles formed between a pair of shorter rows on each side thereof.

* * * * *